US008082996B2

(12) United States Patent
Kocis et al.

(10) Patent No.: US 8,082,996 B2
(45) Date of Patent: Dec. 27, 2011

(54) EQUIPMENT FOR EXCAVATION OF DEEP BOREHOLES IN GEOLOGICAL FORMATION AND THE MANNER OF ENERGY AND MATERIAL TRANSPORT IN THE BOREHOLES

(76) Inventors: Ivan Kocis, Bratislava (SK); Tomas Kristofic, Bratislava (SK); Igor Kocis, Bratislava (SK)

( * ) Notice: Subject to any disclaimer, the term of this patent is extended or adjusted under 35 U.S.C. 154(b) by 107 days.

(21) Appl. No.: 12/666,224

(22) PCT Filed: Jun. 27, 2008

(86) PCT No.: PCT/SK2008/050009

§ 371 (c)(1), (2), (4) Date: Dec. 22, 2009

(87) PCT Pub. No.: WO2009/005479

PCT Pub. Date: Jan. 8, 2009

(65) Prior Publication Data

US 2010/0224408 A1 Sep. 9, 2010

(30) Foreign Application Priority Data

Jun. 29, 2007 (SK) ..... 5087-2007

(51) Int. Cl.
*E21B 37/00* (2006.01)

(52) U.S. Cl. ..... 166/311; 166/163; 175/424

(58) Field of Classification Search ..... 175/11, 175/17, 424; 166/311, 162, 163
See application file for complete search history.

(56) References Cited

U.S. PATENT DOCUMENTS

| | | | | |
|---|---|---|---|---|
| 1,329,072 A | | 1/1920 | Chase | |
| 3,788,703 A | | 1/1974 | Thorpe | |
| 4,185,703 A | * | 1/1980 | Guerber | 175/17 |
| 4,268,197 A | * | 5/1981 | Burgsmuller | 408/59 |
| 5,168,940 A | | 12/1992 | Foppe | |
| 6,591,920 B1 | | 7/2003 | Foppe | |
| 7,152,700 B2 | * | 12/2006 | Church et al. | 175/320 |
| 2010/0218993 A1 | * | 9/2010 | Wideman et al. | 175/17 |

FOREIGN PATENT DOCUMENTS

| | | |
|---|---|---|
| DE | 195 34 173 A1 | 3/1997 |
| DE | 199 09 836 A1 | 9/2000 |

* cited by examiner

*Primary Examiner* — Daniel P Stephenson
(74) *Attorney, Agent, or Firm* — Hovey Williams LLP

(57) ABSTRACT

Utilization of geothermal energy in depths above 5 km could contribute considerably to resolving the global problems related to a lack of energy and to glasshouse gases from fossil fuels. The invention describes innovative equipment which makes deep holes in geological formations (rock) by disintegrating the soil into blocks carried to the land surface through the excavated hole filled with liquid, using transport modules yielded up by gas buoyancy interaction in the transport module utilizing supercavitation. In an opposite direction—by help of negative buoyancy—the necessary energy carriers, materials and components, or entire devices required for rock excavation, are carried to the bottom. The opportunity to transport rock in entire blocks reduces energy consumption considerably, because the rock is disintegrated in the section volumes only. Some of the extracted rock and material carried from the surface is used to make a casing of the hole using a part of the equipment. The equipment also allows the generation of the necessary high pressure of liquid at the bottom of the hole, to increase permeability of adjacent rock. The equipment as a whole allows by its function that there is almost linear dependence between the price and depth (length) of the produced hole (borehole).

4 Claims, 10 Drawing Sheets

EQUIPMENT FOR EXCAVATION OF DEEP BOREHOLES IN GEOLOGICAL FORMATION AND THE MANNER OF ENERGY AND MATERIAL TRANSPORT IN THE BOREHOLES

This application is a National Stage filing under 35 USC §371 of International Application Serial No. PCT/SK2008/050009 filed 27 Jun. 2008 which claims the benefit of Slovakia application no. PP 5087-2007 filed 29 Jun. 2007, the disclosures of both of which are incorporated herein by reference.

FIELD OF THE INVENTION

The present invention concerns equipment used for excavation of deep boreholes in geological formations and the manner in which energy and material is transported in the boreholes.

BACKGROUND ART

At present, crude oil and gas extraction, and geological or geothermal bores are realised by help of drilling rigs where rock is disintegrated by rotating drilling heads mounted at the end of assemblies of connected basic piping and rotated by driving units on land surface. Disintegrated rock is transported to land surface by help of special liquid circulating in the piping and in the drilled hole. There were efforts to put the driving units close to the drilling head and to bring energy from the land surface, but with transport of the crushed rock in classical manner—by help of highly viscous, quick-circulating liquid.

Primarily during the last decade, new methods of more effective rock disintegration and transport to land surface have been sought for.

In the latest study made at MIT (USA) "THE FUTURE OF GEOTHERMAL ENERGY"—IMPACT OF ENHANCED GEOTHERMAL SYSTEMS (EGS) ON THE UNITED STATES IN THE 21ST CENTURY 2006 the principal importance of resolving an economical method of making deep geothermal boreholes is pointed out. With current drilling technologies, the bore price grows exponentially with its depth. Thus, finding a boring technology allowing approximately linear growth of bore price and depth is an imperative challenge.

In his presentation, Jefferson Tester, a co-author of the above study, characterises the requirements related to a new, fast and ultra-deep boring technology as follows:

- linear growth of the price of the bore with depth
- neutral floating of the bore axis
- the ability to make vertical or inclined boreholes more than 20 km deep
- the ability to make large diameter boreholes—up to five times larger than on land surface
- casing formed on site in the borehole.

Above 20 innovative technologies of geological formation boring are known, with various maturity and verification levels.

Only the most promising ones, and those verified already, will be described within the state-of-the art.

Survey of Current Technologies

Technologies can also be evaluated according to properties such as specific energy needed to extract one cubic centimeter, maximum power applicable at borehole bottom, or maximum drilling rate achievable.

From the above viewpoints, the following methods are on the leading places: mechanical principles, underwater electro-spark discharge, and water jet cutting.

The extrapolation solutions which still lack the radical innovation properties necessary for deep geothermy include the following examples:

- drilling by help of rotary casing (TESCO CASING DRILLING)—one set of piping is removed, but the principal negative features of mechanical boring remain unchanged;
- composite coil piping with electric conductors for downhole drive (HALLIBURTON/STATOIL-ANACONDA)—the technology avoids the rotary boring pipe element used for mechanical energy transfer, only the function of crushed rock flush-out remains.

A considerable progress towards a significant innovation is represented by U.S. Pat. No. 5,771,984, authored by Jefferson Tester et al.: "CONTINUOUS DRILLING OF VERTICAL BOREHOLES BY THERMAL PROCESSES: ROCK SPALLATION AND FUSION", where energy is supplied to the drilling rig at borehole bottom by pressurised water for borehole flushing and for driving the turbine, and for generating electric energy for the drilling process by thermal spallation or melting of rock. This invention is the basis for the work carried out by Potter Drilling LLC company, whose technologies are in the prototype testing stage already.

Related technologies are described in v U.S. Pat. No. 5,107,936 "Rock Melting Excavation Process" in which the author Werner Foppe describes the process of rock melting along the borehole circumference, pressing the melt into the core and subsequent core disintegration. In U.S. Pat. No. 6,591,920 the same author describes rock melting and pressing thereof into the surrounding ground.

Plasma jet rock cutting is described in U.S. Pat. No. 3,788,703 authored by Thorpe; however, removal of crushed rock is not covered.

At Tel Aviv. University, Jerby et al. described rock spallation by local microwave overheating in Journal of Applied Physics 97 (2004). The technology is applicable to very small volumes so far.

Most patents refer to water jet rock cutting.

Different modification variants are described, e.g. utilisation of cavitation, turbulent processes, combination with mechanical processes, etc. For example, U.S. Pat. No. 5,291,957 describes the water jet process combined with turbulent and mechanical processes.

During the recent decade intense research has been made into utilisation of high energy laser beams for rock disintegration. Primarily conversion of military equipment is concerned.

Laser energy is used for the process of thermal spallation, melting, or evaporation of rock.

The patent by Japanese authors—Kobayashi et al.: U.S. Pat. No. 6,870,128 LASER BORING METHOD AND SYSTEM describes laser boring with the light beam carried from the ground to the borehole bottom via optical cable. The system evaporates rock, and thus high energy demand results.

In the paper LASER SPALLATION OF ROCKS FOR OIL WELL DRILLING, published in Proceedings of the 23rd International Congress on Applications of Lasers and Electro-Optics 2004, Zhiyue Xu et al. describe thermal spallation method which is more advantageous as to energy, but crushed rock is being removed by help of classical flushing.

The methods utilising electric discharge are based on long-term experience gained in other application areas. The method described in U.S. Pat. No. 5,425,570 by G. Wilkinson is based on combination of electric discharge and subsequent explosion of a small dose of explosive or induced aluthermic process.

U.S. Pat. No. 4,741,405 and U.S. Pat. No. 6,761,416 by W. Moeny describes the use of multiple electrodes with high voltage discharge in aquatic environment; crushed rock is removed by help of classical flushing.

A similar method is described in U.S. Pat. No. 6,935,702 by Okazaki et al.—"CRUSHING APPARATUS ELECTRODE AND CRUSHING APPARATUS", with classical flushing used.

A. F. Usov describes utilisation of electric discharge for large diameter (above 1 m) drilling with several m/h speed, realised at the Kola Research Centre, Russian Academy of Sciences.

In the patent RU 2059436 C1, V. V. Maslov describes generation of high voltage pulses for material destruction.

In the paper "Pulsed Electric Breakdown and Destruction of Granite" published in Jpn. J. Appl. Phys. Vol. 38 (1999), 6502-6505, Hirotoshi et al. describe successful use of electric discharge on granite, a typical geothermal rock.

Utilisation of buoyancy in boring is not new; for example, in U.S. Pat. No. 4,422,801 "Buoyancy System for Large Scale Underwater Risers" Hale et al. describe undersea utilisation of buoyancy to lift heavy burdens, where effective manipulations are achieved by variable buoyancy of ballast vessels, although at high costs.

U.S. Pat. No. 5,286,462 by J. Olson describes the system of quick gas generation for fast discharge of ballast vessels to make use of buoyancy for load manipulation.

The problem of fast movement of an object in water—a key factor for transport efficiency—is handled for military purposes in U.S. Pat. No. 6,962,121 BOILING HEAT TRANSFER TORPEDO by R. Kuldinski, and in U.S. Pat. No. 6,684,801 SUPERCAVITATION VENTILATION CONTROL SYSTEM; here the artificial supercavitation method is described, with which objects of suitable shape can reach the velocity of even several hundreds of meters in water.

Apparatus for deep simulation at borehole bottom and the importance of pressure generation at borehole bottom by autonomous power system are described in U.S. Pat. No. 4,254,828 APPARATUS FOR PRODUCING FRACTURES AND GAPS IN GEOLOGICAL FORMATIONS FOR UTILIZING THE HEAT OF THE EARTH by Sowa et al. Similarly, U.S. Pat. No. 7,017,681 by Ivannikov et al. describes an autonomous simulation system utilising hydrodynamic effects at borehole bottom.

From the viewpoint of realisation of continuous casing production, the current state-of-the-art offers a suitable solution, because concrete mixtures with quick underwater solidification and high strength have been developed and introduced into practice, mostly for military purposes. Such concrete types have been developed for storage of dangerous waste as well.

Summary of State of Current Technologies

However, none of the above methods was successful in reaching substantial saving during boring, due to simultaneous effect of several factors:

- transport of extracted material to the ground remained unsolved
- supply of energy
- considerable energy demand—the need to crush the entire borehole volume to small particles, or even (with laser technologies) to evaporate it.

Effectiveness of the above technologies is also opposed by the presence of liquid (water, viscous transport liquid) in the borehole. To supply the energy, e.g. pressurized water supply, electric energy supply via a cable, composite flushing pipe, optical fibre cables supplying high-power laser energy were used. All of them assume a permanent, constantly extending connection of the borehole bottom with the ground. Similarly, crushed rock transport still depends upon extending transport medium piping.

An equally important part of the borehole is casing of its walls by subsequently inserted pipes which, moreover, are narrowing with borehole length, and thus cause overall throughput reduction and contribute to inadequate boring price increase with bore depth. Recently, expandable casing with uniform cross section along the whole borehole has been developed; this, however, provides a partial solution of exponential boring price only.

None of the boring technologies described so far brought an innovation which would bring along a substantial change in effectiveness of the entire process and of transport of crushed rock to the ground, and which would provide for ultra-deep boring (above 5 km) with approximately linear price dependence guaranteed. The status described above thus implies that a technology is needed which would avoid the cons of the current situation in relation to the following aspects:

- Transport of energy downwards to the boring process.
- Transport of crushed rock upwards so that direct continuous connection between the ground and the boring rig at borehole bottom would be abandoned in a manner independent upon actual borehole depth.
- The casing process would be continuous, parallel with borehole formation.
- Achieving energy savings in relation to rock disintegration and transport to the ground.
- The possibility to cut rock into blocks and to transport them to the ground.
- Functioning ability of the equipment even under high pressures and temperatures in boreholes (openings in rock) flooded with water.

SUMMARY OF THE INVENTION

The invention application is from the relates generally to geological boring technology, in particular to excavation of deep bores for extraction of materials and for geothermal purposes. The invention refers to innovative equipment performing bore excavation in an innovative manner providing for transport of energy in the downward direction, transport of rock to the ground, and casing of the borehole thus formed.

Utilisation of geothermal energy in depths above 5 km could contribute considerably to resolving the global problem of energy shortage and glasshouse gases from fossil fuels.

Equipment for excavation of deep boreholes in geological formation, which uses the source of energy from energy carrier transported from the ground by the transport module for rock cutting and for other operations at the borehole bottom; the transport module also carries material from the bottom to the ground and vice versa; the equipment consists of:

a) underground base operating at the borehole bottom;
b) transport module for load transport between the underground- and ground bases in both directions;
c) ground base for loading and unloading of the transport module, refilling of the operation liquid into the borehole, and for servicing operations;
d) hole in the geological formation filled with liquid, used as the means for transport.

Wherein the underground base consists of at least one of interconnected modules:

a) the cutting module, including a system of units making up the cutting rig for making thin rock slices in the manner selected from the following group: pressurized water jet, electric discharge with pressure wave, laser, thermal spallation, plasma jet, mechanical crushing or other cutting tool; it also includes a system of components used to handle crushed and cut rock in the underground base and in the transport module;

b) the module for generating the operation medium and energy for the cutting process, and for handling the cut-off blocks and crushed rock, as well as for operation of other modules of the underground base;

c) lines, pipes and conductors for energy and material distribution between at least two of the following units: the underground base and/or any of its modules, and the transport module;

d) the source of energy;

e) the communication module;

f) the module for stimulation of adjacent rock to create artificial cracks to be used, e.g. for a geothermal heat exchanger;

g) the module for underground base displacement in the borehole following to the cutting process, the casing production process and the rock transport process;

h) the module for continuous production of the borehole casing, processing some of the crushed rock, material carried from the ground and water to make a mixture which is being extruded and then shaped by the travelling casing;

i) the buoyancy vessel being used for the return of the underground base to the ground following the end of boring, or in case of a necessary repair;

j) the connectors for interconnection with the transport module used to transmit signals, media, materials and energies;

k) the transition channel leading from the rock to the transport module connectors;

l) the underground base control unit used to control the operation and interaction of the modules.

Wherein the transport module also includes at least one of the following modules:

a) the buoyancy module with controlled buoyancy from generated pressurized gas from the cutting process or from the gas generator, and/or from a liquid lighter than the operation liquid;

b) the autonomous drive module using fuel for reactive or mechanical drive;

c) the drive module using overpressure during transport module rising from the underground base to the ground base;

d) the module providing for reduction of the transport module friction in relation to the operation liquid in the hole;

e) the module providing for generation of gas into the buoyancy module;

f) the module providing for generation of pressure for the drive of fuel into the cutting module;

g) the source of energy;

h) the transport module control unit;

i) the communication module;

j) the vessel for the energy carrier;

k) the vessel for material;

l) the vessel for crushed rock;

m) the vessel for rock blocks;

n) conductors and connectors of the gas from the cutting process;

o) conductors and connectors of fuel and energy for the cutting and handling process, including operation media filters.

The transport module envelope shape allows for gliding hydrodynamic buoyancy in interaction with the borehole wall, and thus makes use of the supercavitation effect to achieve high velocities in the operation liquid.

Wherein the module for continuous production of casing also includes the following:

a) the module for producing a mixture from crushed rock, material transported from the ground and water;

b) openings, connectors for supply of material;

c) opening, connectors for extrusion of the mixture;

d) travelling casing for shaping the mixture into sheathing.

Overpressure in the transport module during rising of the transport module from the underground base towards the ground base is used to drive acceleration of the transport module movement.

The module for generating the cavitation ventilation flow providing for reduction of friction of the transport module in relation to the liquid in the hole by ventilated supercavitation to reach high velocities in water makes use of at least one of the following:

a) overpressure in the transport module during transport module rising from the underground base towards the ground base;

b) pressure medium formed in the autonomous drive module when fuel is used for reactive or mechanical drive;

c) gas generator;

to create and stabilize the supercavitation effect with the contribution of increased temperature of the transport module envelope, while interruption of the supercavitation effect is utilized for hydrodynamic decelerating effect to reduce the module speed.

In most deep boreholes water can be found, coming there either in natural or artificial manner. The presence of water is due to either natural leakage or to artificial introduction for technological purposes, or to the need to compensate outside rock pressure. In the water (liquid flooded) environment, borehole pipes and pumped viscous liquids are used to transport rock to the ground.

Liquids have a well-known property—the effect of buoyancy upon submerged objects. Buoyancy is either positive or negative, depending upon whether specific density of the object is lower or higher than that of the liquid. The volume of gas or liquid contained in the object its rise or submersion can be achieved. This feature has been applied since long ago for submarine manoeuvring, where total integral specific density is changed by filling the tanks with water (submersion) or expelling the water from the tanks by compressed gas (rising). The object rises up to water surface without further energy demand, irrespective of the depth from which the object is to rise. Similarly, an object with specific mass higher than water submerges into any depth down to the bottom.

The nature of the invention is in the utilisation of autonomous movement of the transport container—transport module with no physical connection (by a cable, pipe, etc. either) with the ground (surface base.

Transport module of a suitable shape can carry energy carriers, oxidizing agent, material, or equipment components from the rock opening surface down to the bottom.

Analogously, the transport module having a part filled with pressurized gas will have lower total specific density than water, and can, in interaction with a different type of drive, transport a load, rock, energy carrier tanks or an equipment component for replacement or servicing from the bottom to the ground.

As the transport is performed by help of transport module, the rock need not be crushed, but can be in large compact blocks. This implies a significant fact, namely that rock can be separated by cuts with the volume representing only a fraction of the extracted rock; thus, considerable energy saving will result, as well as block shape unification and larger borehole diameter.

Following the start-up of the transport module from the bottom the transport does not depend upon depth (length of the passed trajectory). The transport module is rising continuously, until it reaches the ground, without any additional energy.

According to the invention, some of the cut rock is used to produce continuous casing along with passage of the drilling rig towards greater depth. Special bonding agent is carried from the ground.

The underground base operating at the borehole bottom includes the cutting equipment proper, for which energy is supplied by energy carriers in the transport module. As energy carriers, fuel (liquid hydrogen, ethanol, gasoline, other type of fuel (explosive)) and oxidizing agent (liquid oxygen, air, etc.) can be used.

The combustion process renders energy to the cutting process in different manners: mechanical movement of turbine, cutting water pressure, turbine used to produce electric energy for laser, spallation, etc. Mechanical energy is also used to handle crushed rock (particles, blocks). Gas combustion flue gases fill the transport modules tanks—they expel water, and thus contribute to generation of the buoyancy necessary for the transport. Thus, the transport modules can be locked against movement up to the start of transport.

The total pressure and gas volume necessary to expel the necessary water volume is made up by the process in the transport module itself (controlled explosion, interactions of two components forming high gas pressure, etc.).

The equipment at borehole bottom—the underground basis—includes, beside the cutting equipment, the equipment handling transport of rock into the transport module and a part of the equipment where the energy from energy carriers is transformed to a suitable and applicable form of energy. There is also the control unit (partly in the transport module as well). An important part is represented by mixing and forming equipment for continuous casing formation.

The transport module can have either the form of a cylinder, with the diameter smaller than inside diameter of the casing, or the form of a different fraction of cylinder (section in parallel with the cylinder axis). It is good to have several containers running simultaneously in both directions.

The above-ground part of the equipment—the ground basis—performs discharge of the transport module, removal of the rock, and loading the transport module with new energy carriers, materials and spare parts for the cutting equipment, and/or other components for the equipment at borehole bottom.

Gas pressure balancing during transport module rising can be used with advantage for additional drive of the transport module by the reactive force of the escaping gas, or to generate additional buoyancy by expansion of the gas in the transport module. As in depths of 5 to 10 and more km liquid (water) pressure is approx. 500-1000 MPa and its temperature is 300-500° C., the equipment, including the control unit, must be able to operate at the above pressure and temperature, and must be designed without hollows or spaces with lower pressure.

To speed up the transport module movement in water, natural or artificial super-cavitation is used. To generate it and to make it stable, gas from the buoyancy vessel is made use of, with gradual pressure balancing, as well as gas generator, either autonomous or as a part of a different type of drive (e.g. reactive).

The cutting process can be of various types—e.g. preferably water jet cutting, laser cutting, thermal spallation cutting, melting, etc.

The transport modules may also include parts such as cutting equipment unit, control unit, energy conversion unit, etc.

DETAILED DESCRIPTION OF THE INVENTION

The figures show the sequence starting with current state-of-the-art and following with some preferable embodiments of the invention.

Figure 1:
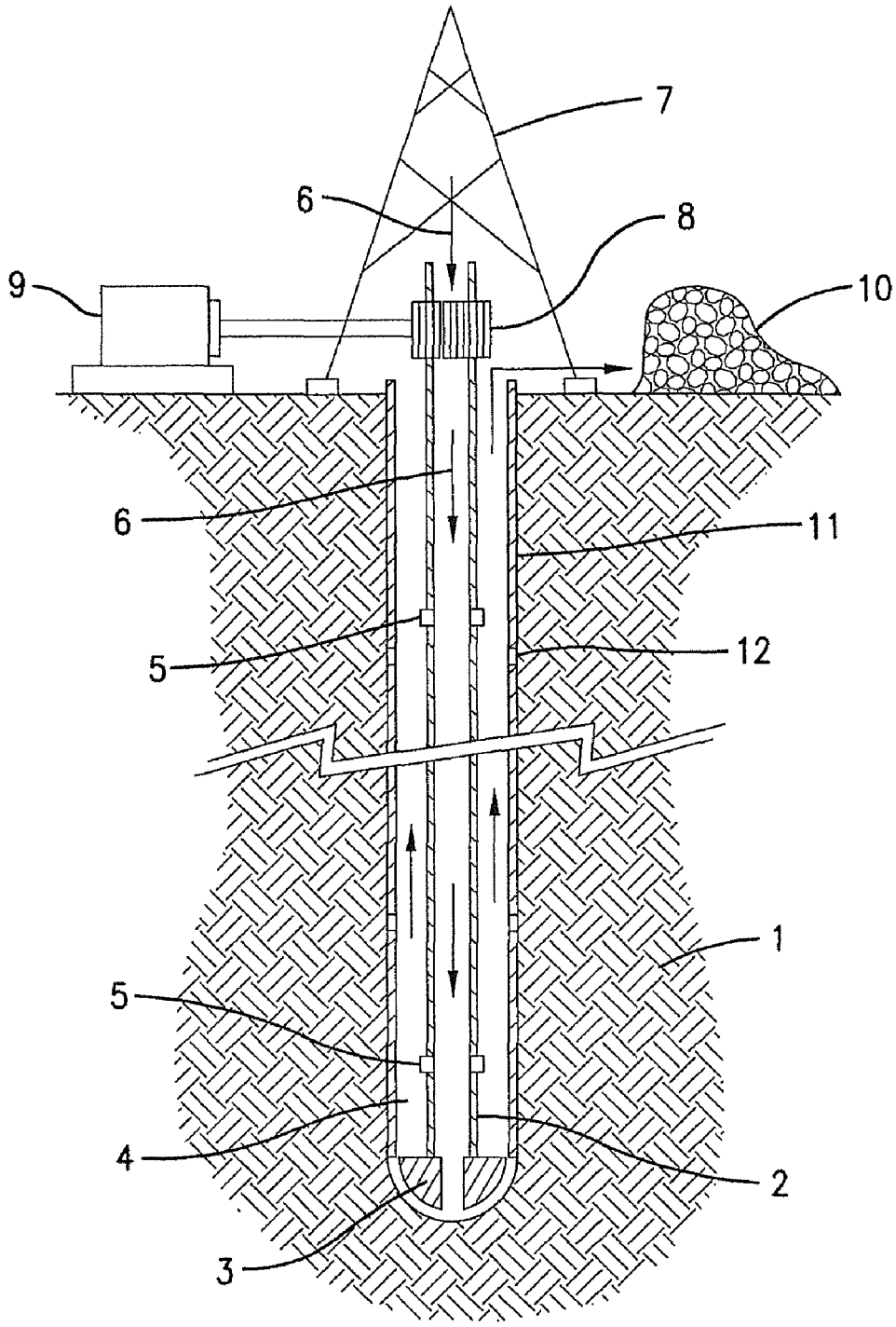
Fig. 1. PRIOR ART
FIG. 1 is an elevational view in partial cross section of a system according to the present state of the art of boring in a geological formation.

FIG. 1 shows current state-of-the-art of making a borehole in geological formation.

In geological formation 1.1 borehole 1.4 is made using torsion piping 1.2, on the bottom end of which drilling head 1.3 is attached equipped with special high resistance teeth through which liquid 1.6 intended for rock flushing flows. The torsion piping consists of several parts and sections connected by joints 1.5, and is being extended in proportion to the borehole depth achieved.

In a geological formation 1, a borehole 4 is made using torsion piping 2, on the bottom end of which a drilling head 3 is attached equipped with special high resistance teeth through which liquid 6 intended for rock flushing flows. The torsion piping consists of several parts and sections connected by joints 5, and is being extended in proportion to the borehole depth achieved.

The torsion piping 2 is rotated by drive 9 via transmission device 8. Liquid (mostly water, but often also highly viscous squash) 6 is forced into the torsion piping; the liquid 6 transports the borehole material to the surface via the remaining borehole space (flushing), where rock 10 is separated and the liquid is collected.

Casing 11—piping consisting of components connected by joints 12—is usually inserted into the borehole 4.

The torsion piping and casing piping sections are usually handled by help of boring rig 7 equipped with a crane and a rotary grip.

In some embodiments according to the current state-of-the-art, the head 3 is equipped with autonomous drive with energy supply from the ground via piping 2, which is not rotary.

Figure 2:
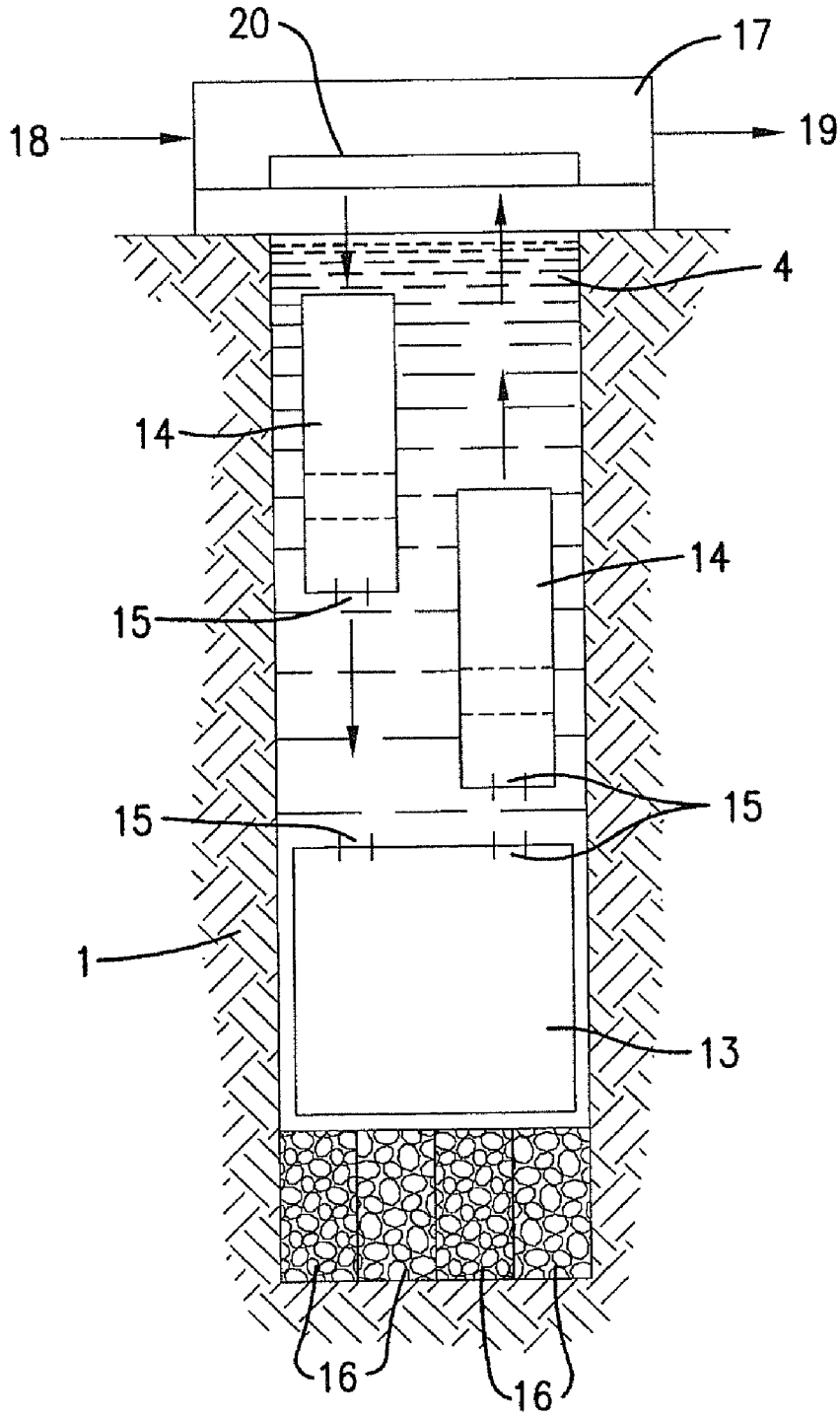
FIG. 2 is an elevational view in partial cross section of one preferred embodiment of equipment and the main parts thereof for boring in geological formation according to the present invention.

FIG. 2 shows a preferable embodiment of the equipment and of its main sections according to the invention.

The equipment for deep excavation of rock in a geological formation 1 bores borehole 4 filled with a liquid. The equipment consists of underground base 13 which makes thin cuts into the rock 16 on the bottom of borehole 4, producing rock blocks 16 there. Subsequently, the underground base 13 transfers a cut-out block into the transport module, i.e. into transport container 14.

During the loading phase the transport module or container 14 is anchored by connectors 15 to an underground base 13. While the container is anchored, an energy carrier used to drive the cutting and handling processes is transferred from container 14 into the underground base 13.

During the operating cycle of underground base 13 the tanks of container 14 are filled with gas (lighter than water) at given pressure and temperature and in the volume required for overall positive buoyancy of the transport module or container 14 loaded with rock blocks.

Following mechanical detachment of container 14 the container starts its way up by positive buoyancy in the water in borehole 4 continuously up to gate 20 on the ground where the container is unloaded in the surface base 17 to output 19.

Following loading with energy carrier or other material from input 18 and following filling up the buoyancy tanks by water via gate 20, the transport module 14 starts its way down via borehole 4 through the water down to underground base 13 where it is connected to connectors 15.

The above equipment operation cycle is repeated.

Figure 3:
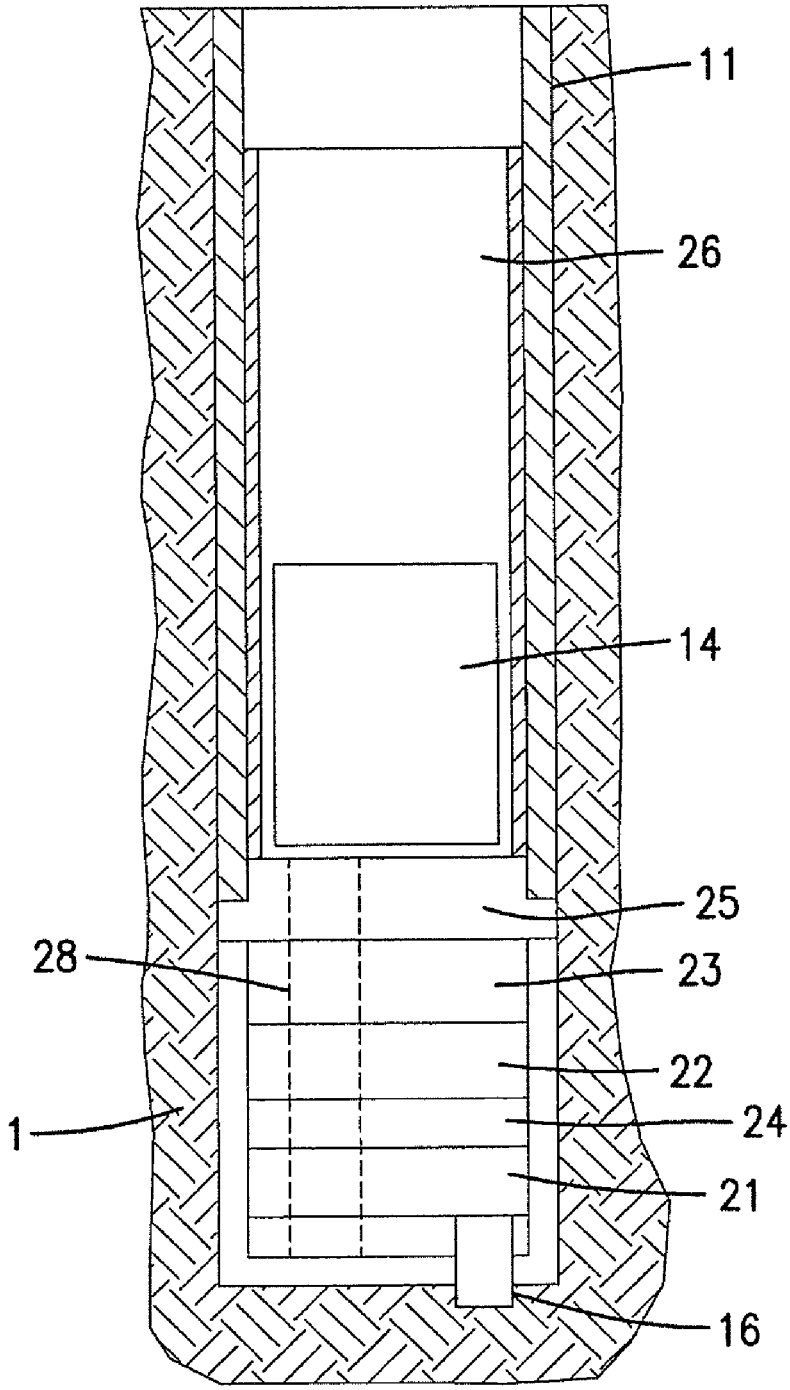
FIG. 3 is a cross sectional view of the equipment of the present invention showing the underground base.

FIG. 3 shows detailed scheme of a preferable embodiment of the underground base.

At the bottom of the borehole 4 in geological formation 1 including rock there is the cutting module 21, consisting of a system of elements making up the cutting rig to make thin slices of a planar, cylindrical or otherwise curved surface applying the principle of pressurized water jet cutting, laser cutting, plasma jet cutting, thermal spallation, electric discharge or other suitable method.

The cutting process may be preferably selected so that, simultaneously with cutting, glass-like smooth surface would be formed on the borehole surface to act as impermeable layer for the exploitation phase.

The module may include components penetrating deeply into the cuts in the rock, being a part of the cutting or handling process.

The underground base also includes module 22 for generating the performance form of energy, e.g. the form of energy necessary for the cutting process, for handling the cut-off blocks or crushed rock, and a suitable energy transfer connections.

The underground base module is also the source of the forms of energy for other modules with which it is connected by suitable lines (e.g. combustion aggregate generating high pressure connected to the turbine, and to electric energy production.

By controlled reaction of the energy carrier, the stimulation module 3.4 generates high water pressure towards the environment to provide for the stimulation process in adjacent rock.

The rig travel module 24 used to provide for controlled travel of entire underground base in the hole for the process following to performance of the cutting process and removal of cut rock blocks.

The transport module 14 is a container including some modules from the following set: buoyancy vessels, energy carrier vessels, energy carriers, spaces for rock blocks, crushed rock and other transported material. The transport module 14 includes connectors with the underground—and ground base modules, control unit, communication module and energy carrier lines to other modules via connectors.

The module of continuous borehole casing production 25 is connected to the cutting module from where crushed rock (the basic material for casing production) is transported, as well as with the operation medium module 22 and with the transport module 14. Module 25 also includes travelling sheeting for the production of casing 26.

From the module for continuous casing production 25 the basic material comes out (receiving the final shape during solidification) via a part of the travelling casing 26; when solidification is complete, solid casing layer 11 is produced.

The entire height of the underground base, from the rock to the transport module 14, is passed through by transition channel 1 28, used for transfer of cut rock blocks 16 into the transport module 14.

As will be recognized by persons having ordinary skill in the art, the sequence in which the modules and functions are ordered in the underground basis is not important.

It is also obvious that mutual sizes of modules 21 through 16 in the figure need not be maintained in various implementations, and are only illustrative.

Figure 4A:
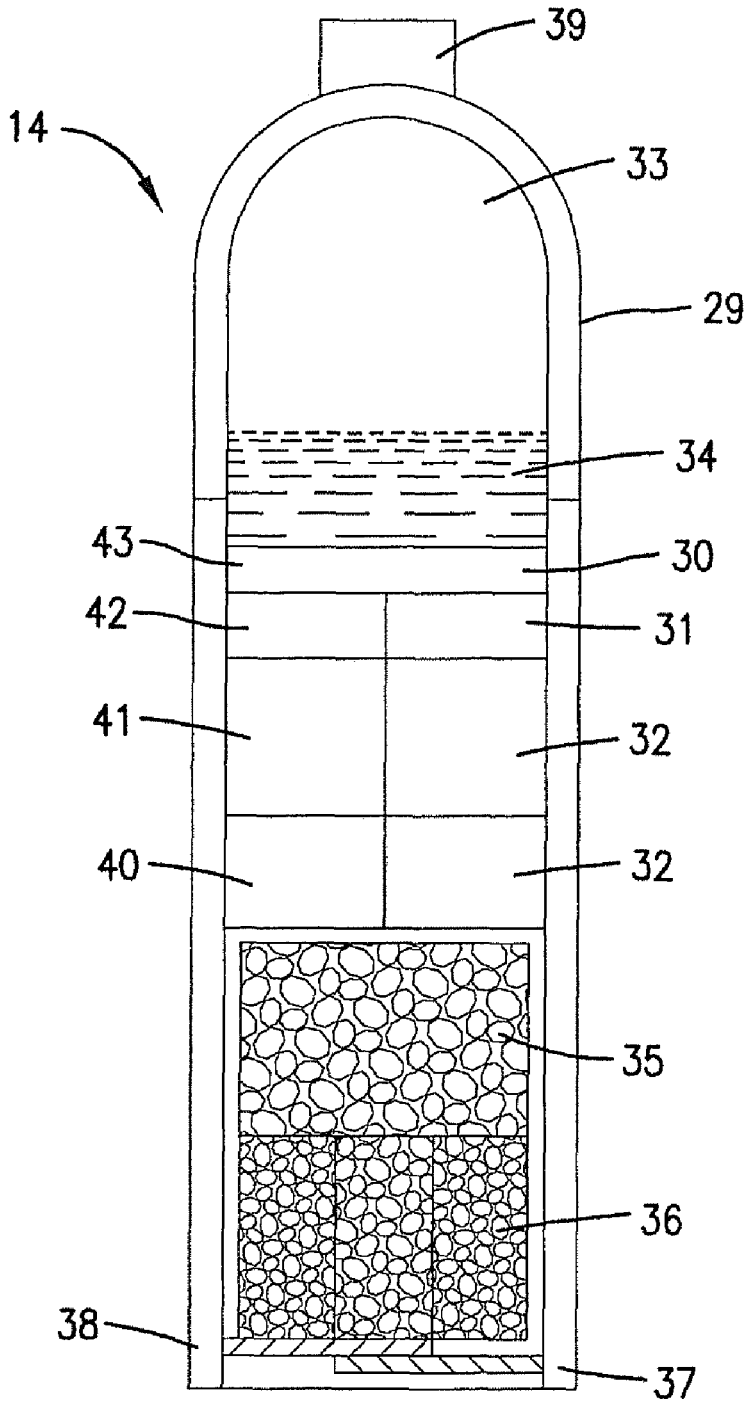
FIG. 4*a* is a cross sectional view of one embodiment the transport module of the equipment of the present invention.
Figure 4B:
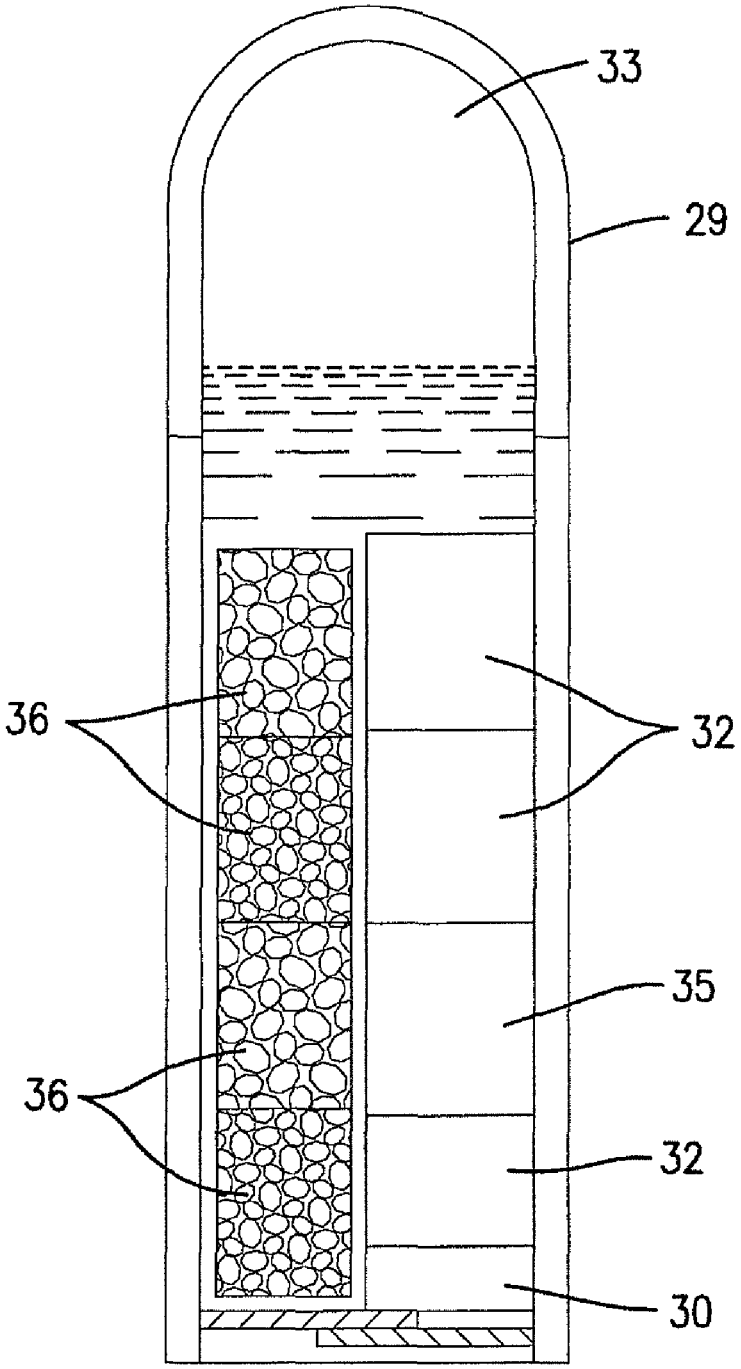
FIG. 4*b* is a cross sectional view of an alternate embodiment of the transport module of the equipment of the present invention.

FIGS. 4*a*, 4*b* show the transport module 14, also referred to in the text as "container".

Transport module 14 is a unit providing for the transport from the ground to the bottom and vice versa, using the principle of buoyancy in a liquid. The transport module 14 carries the energy carrier and various materials (casing binder, filters) from the ground to the bottom. In this mode the transport module is heavier than the liquid, and sinks to the bottom. The buoyancy vessels are filled with water or with the energy carrier.

The transport module 14 carries cut-out rock (either in blocks or crushed) and used equipment components from the bottom to the ground. The buoyancy vessels are filled with air or gas (cutting process waste gases, or specially generated gas from the charge).

During the bottom-to-ground movement, beside buoyancy a fuel-based drive (e.g. reactive or mechanical drive, such as a propeller) can also be used to enhance the effect.

FIG. 4*a* shows a preferable embodiment of transport module 14, consisting of buoyancy module 29 in various ratios of gas and water filling, according to the transport module operation stage. The transport module 14 also includes control unit 30 and gas pressure generator unit 31; its function is to generate pressure for the drive of fuel in fuel vessel 32 to the cutting equipment. During various stages of operation, there is various volume of water 34 in the buoyancy vessel 33.

Transport module 14 also includes fuel vessels 32 and vessels for the material carried from the ground to the underground base 13.

Transport module 14 also includes the vessel for transport of crushed rock 35 and the vessel for transport of rock blocks 36.

To provide for connection of fuel vessels 32 with underground base 13, the module 14 includes piping, conductor and connector of fuel 37.

To provide for connection of underground base 13 and transport module 14, the latter includes piping, conductor and connector of gas 38, through which the cutting process waste gases are transferred to the buoyancy module 29.

The transport module also includes the friction reduction module 39 to reduce friction of the transport module in relation to the liquid in the hole.

The transport module also includes fuel-operated autonomous drive module 40 with reactive or mechanical drive.

The transport module also includes the module 41 for generating the gas for the buoyancy module 29.

The transport module also includes autonomous source of energy 42.

The transport module also includes communication module 43.

The buoyancy module 29 may be provided either as a compact vessel, or preferably as a vessel expandable in telescopic or bellows-type manner shown in FIG. 4*a*.

FIG. 4*b* shows another preferable ordering of the basic modules.

Figure 5A:
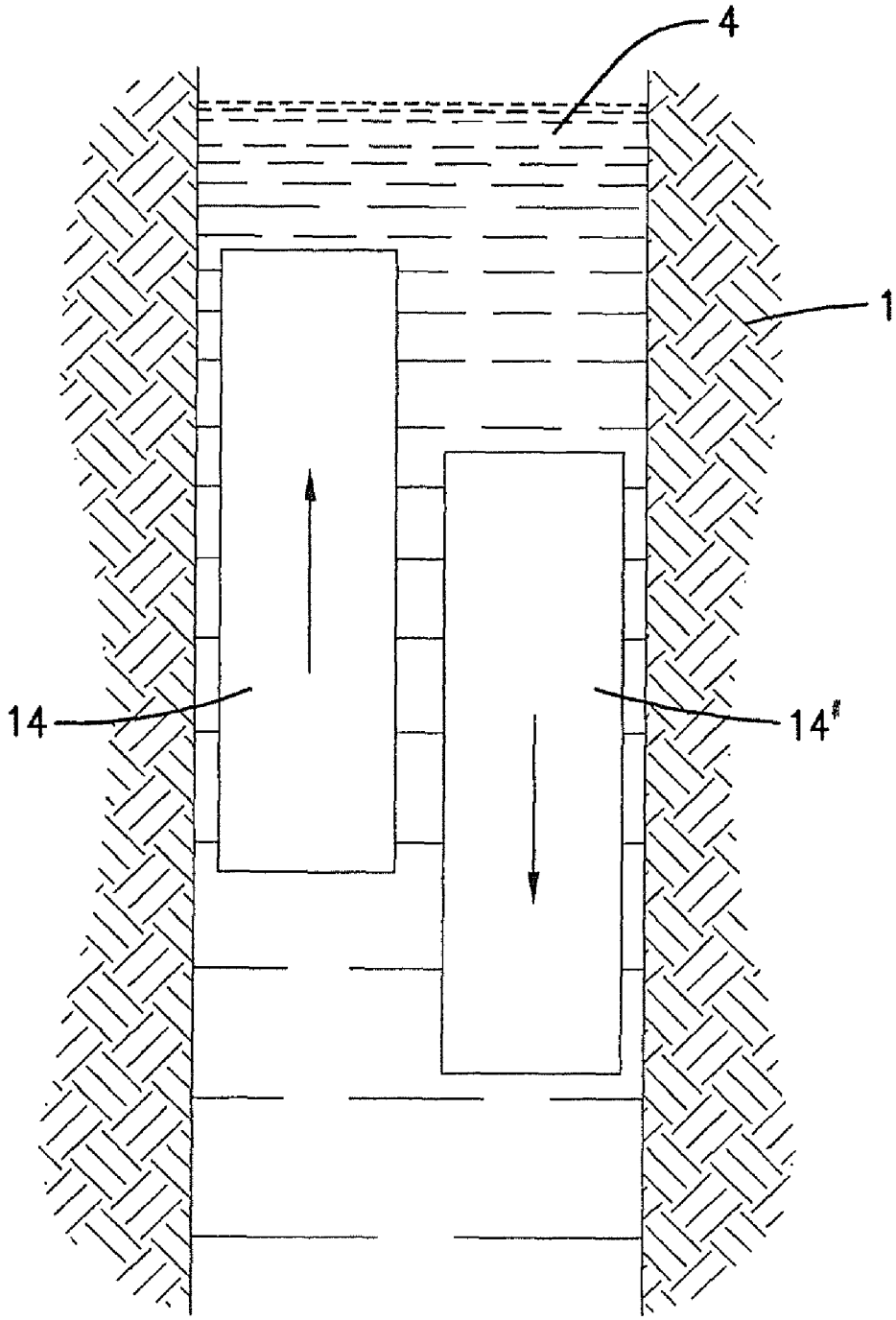
FIG. 5*a* is a cross sectional view of the borehole in the rock or other geological formation showing vertical movement of the transport modules within the borehole.

FIG. 5*a* shows borehole 4 in rock 1, filled with water, in which transport modules 14 and 14' move in mutually opposite directions.

According to transport intensity, either one or more transport modules 14 and 14' can move in the borehole 4.

In the profile of the borehole 4 the transport modules 14 and 14' move so as to avoid collision. This can be provided for e.g. by control unit receiving polarised electromagnetic signal from the module moving in the opposite direction, and directing the module hydro-dynamically into a collision-free orientation. This type of control unit is mounted in all transport modules.

Figure 5B:
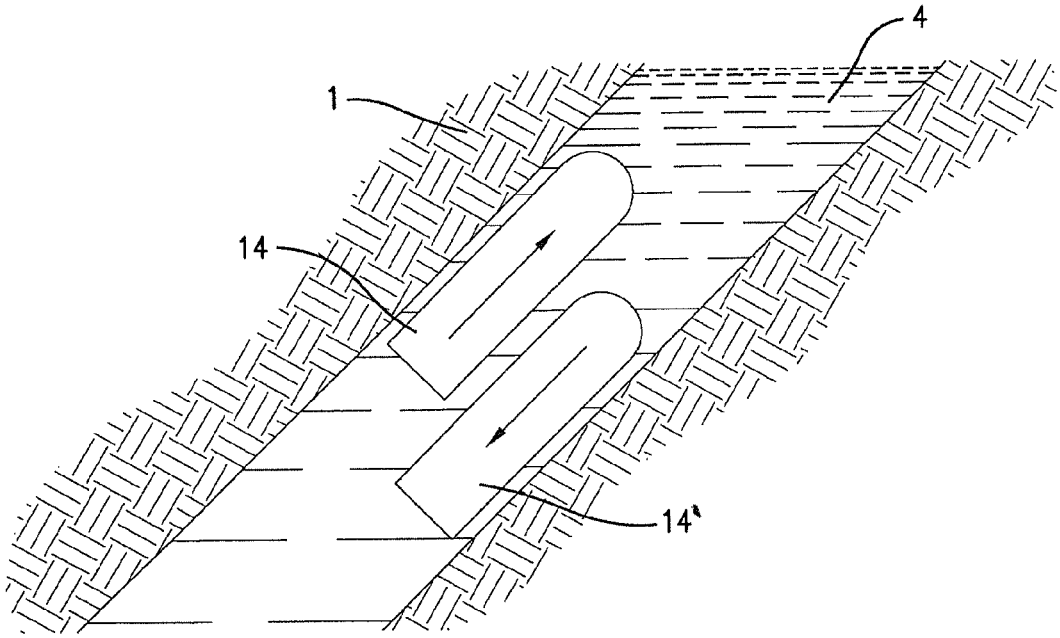
FIG. 5*b* is a cross sectional view similar to FIG. 5*a* of the borehole in the rock or other geological formation illustrating the movement of the transport modules within a borehole oriented at an angle.

FIG. 5*b* shows typical situation in geothermal boreholes excavated at a suitable angle (e.g.)45°, not vertically.

As can be seen in the figure, collision-free orientation and trajectory of transport modules is ensured by their nature itself. The transport module 14', which moves downwards, is heavier than water, and thus it moves along the bottom wall of the hole 4.

The transport module 14, which moves upwards, is lighter than water, and thus it moves along the top wall of the hole 4.

This way, several transport modules can move simultaneously without a collision. It is preferable when the shape of transport modules 14 and 14' allows hydro dynamical gliding along the hole surface, and when the transport modules are equipped with e.g. wheels or jets on the side of contact with the hole surface (for example during running up and out of the transport module, when the hydro-dynamical gliding effect is not in effect still).

Figure 6:
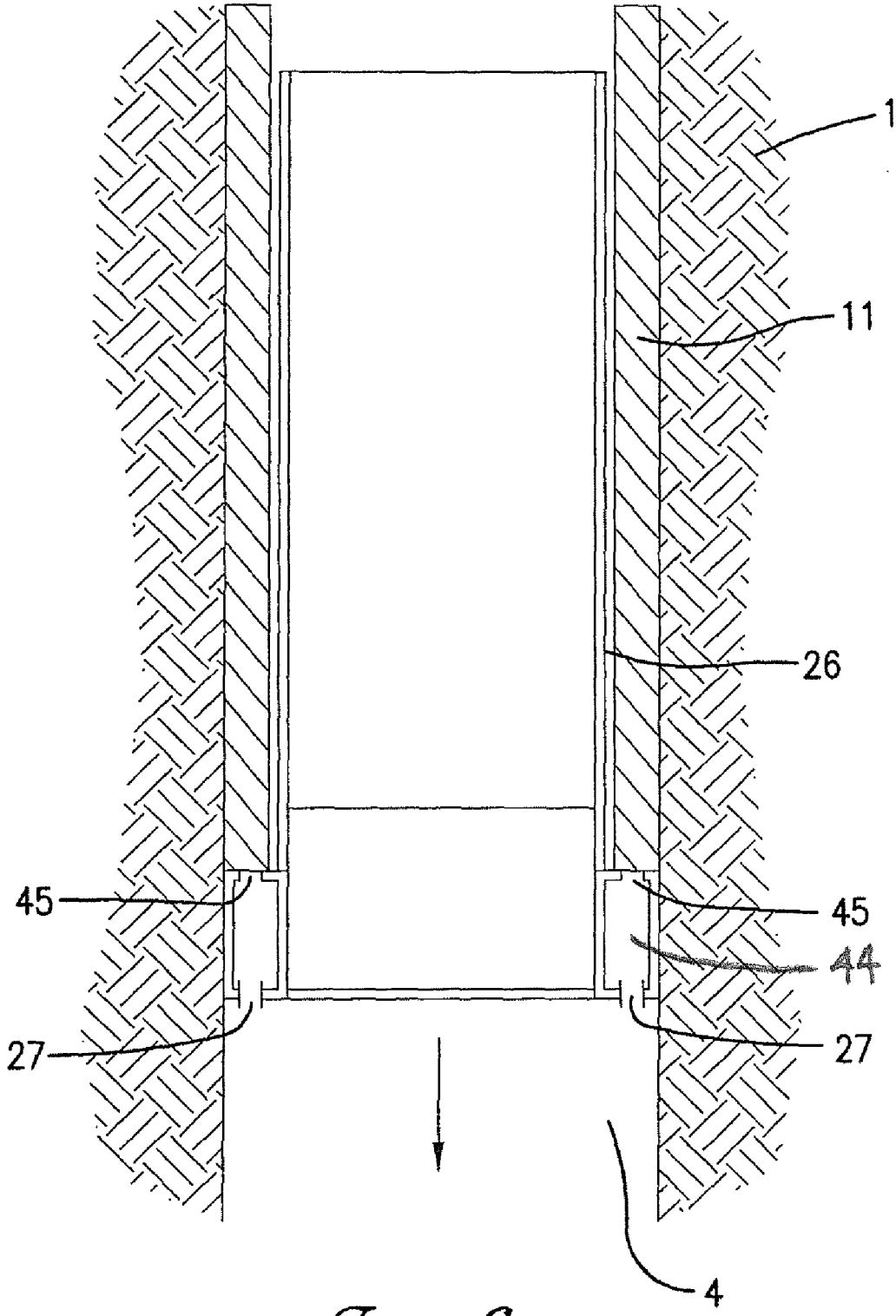
FIG. 6 is a cross sectional view of the module for continuous production of casing of the equipment of the present invention located in a borehole.

FIG. 6 shows the module for continuous casing production consisting of the mixture production module 44, where a mixture is being made from crushed rock, binder carried from the ground, and possibly other additives (steel or plastic reinforcing fibres, water, etc.).

The mixture production module 44 forces the mixture under pressure through openings 45 into the area of casing 11 where, in interaction with travelling sheeting 26, the mixture solidifies and forms continuous casing 11 of the hole 4.

The connectors, or holes, 27 are used for connection with the underground base modules to be used for the supply of energy and material, and/or for connection with the transport module for material supply.

Figure 7:
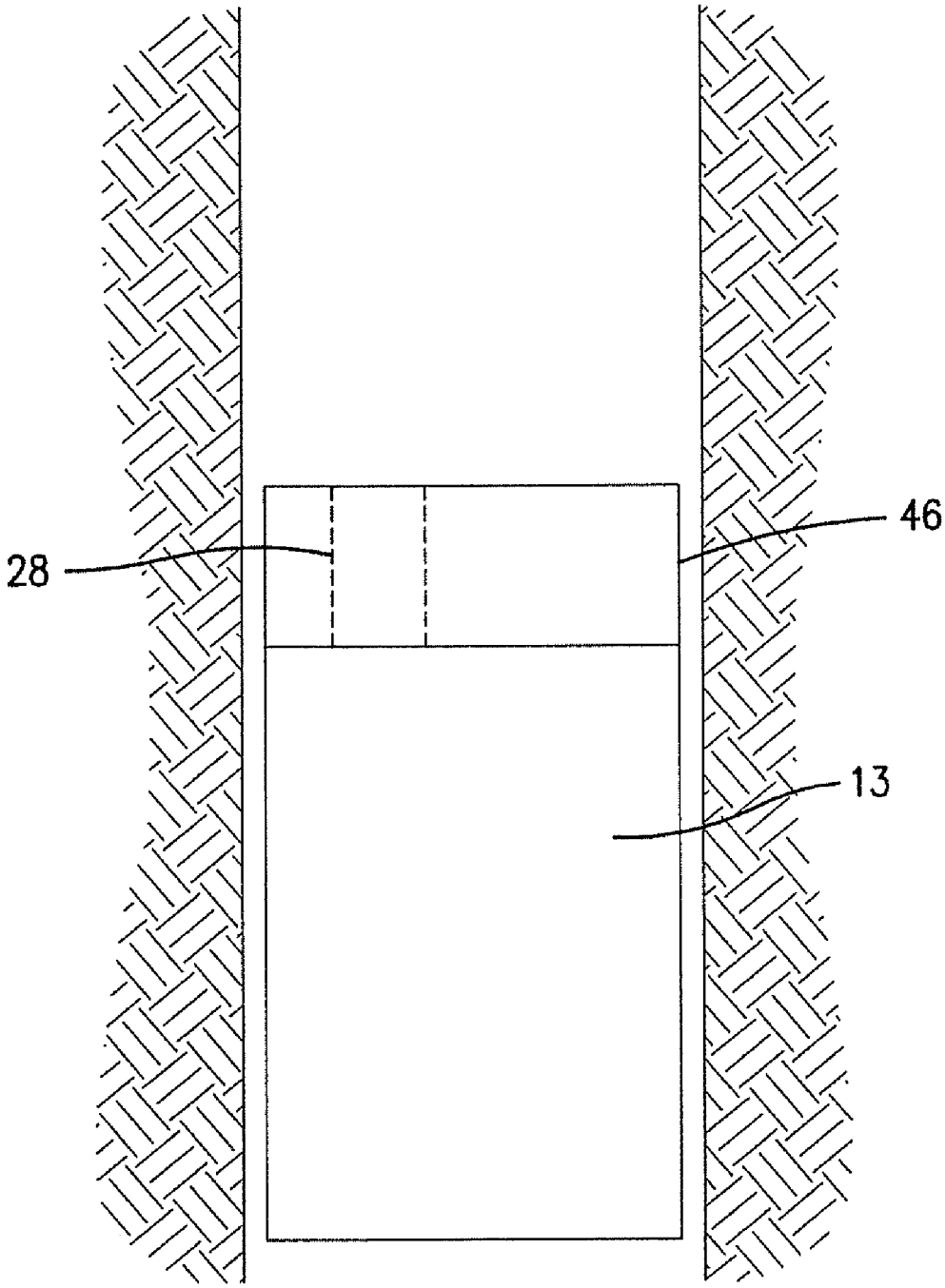
FIG. 7 is a cross sectional view of an embodiment of the underground base of the present invention showing buoyancy vessels.

FIG. 7 shows a preferable embodiment of the underground base 13, including also buoyancy vessels 46 for possible transport of the entire underground base to the ground for repairs, inspection, replacement etc. In the buoyancy vessels area there is a connecting channel 28 for transfer of cut-out rock blocks (or other material) in both directions.

Figure 8:
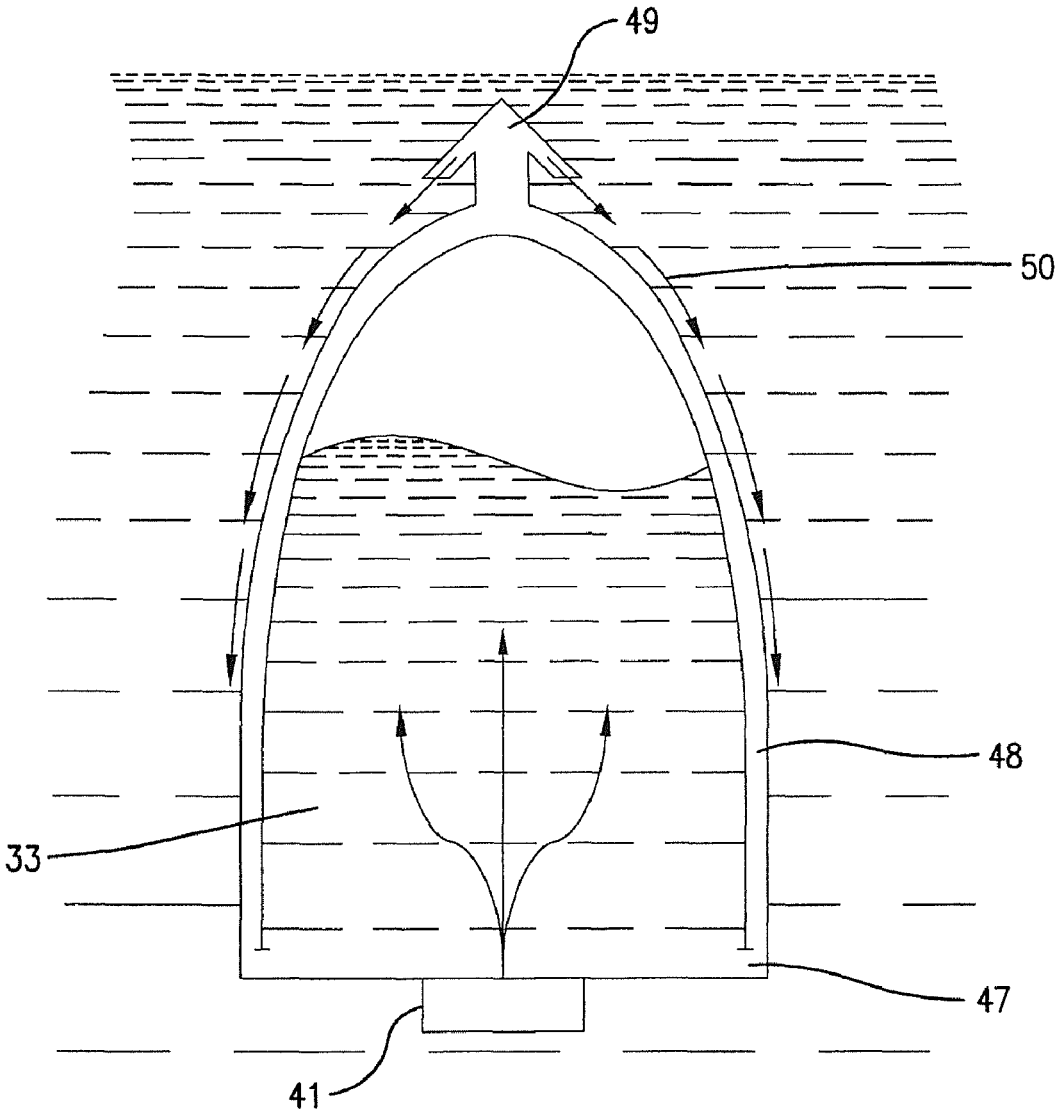
FIG. 8 is a cross sectional view of a preferred embodiment of a part of the transport module which illustrates the flow of liquids and gasses from the buoyancy vessel.

FIG. 8 shows a preferable embodiment of the transport module where after activation (ignition) the gas generator module 41 generates the required volume of high pressure hot gas which forces the liquid out from the buoyancy vessel 33 through openings 47 and the space between envelopes 48 into the module producing cavitation ventilation flow 49. Following the force-out, waste gases follow the route described above, and create both ventilated cavitation, and reactive drive force. High temperature of the outer surface of space 48 supports the occurrence ands stabilisation of the cavitation effect in the cavitation flow 50. The above-described effect is used both during upward and downward movements in the hole.

The invention claimed is:

1. Equipment for excavation of deep boreholes in geological formation, which excavation uses the source of energy from an energy carrier transported from the ground by a transport module for rock cutting and for other operations at a bottom of a borehole and wherein the transport module also carries material from the bottom of the borehole to the ground and vice versa, the equipment comprising:

a) an underground base operating at the borehole bottom;

b) a transport module for load transport between underground and ground bases in both upwardly and downwardly directions;

c) an operation liquid which fills a hole in the geological formation, which liquid is provided as a means for transport; and d) a ground base for loading and unloading of the transport module, refilling of the operation liquid into the borehole, and for servicing operations, wherein the underground base includes at least one interconnected module selected from the group consisting of:

1) a cutting module, including a system of units making up the cutting rig for making thin rock slices in the manner selected from the following group: pressurized water jet, electric discharge with pressure wave, laser, thermal spallation, plasma jet, mechanical crushing and cutting tools;

2) a system of components used to handle crushed and cut rock in the underground base and in the transport module;

3) a module for generating the operation medium and energy for the cutting process, and for handling the cut-off blocks and crushed rock, as well as for operation of other modules of the underground base;

4) lines, pipes and conductors for energy and material distribution between at least two of the following units: the underground base and/or any of its modules, and the transport module;

5) a source of energy;

6) a communication module;

7) a module for stimulation of adjacent rock to create artificial cracks to be used for a geothermal heat exchanger;

8) a module for underground base displacement in the borehole following to the cutting process, the casing production process and the rock transport process;
9) a module for continuous production of the borehole casing, and for processing some of the crushed rock, material carried from the ground and water to make a mixture which is being extruded and then shaped by the travelling casing;
10) a buoyancy vessel adapted for use in the return of the underground base to the ground following the end of boring, or in case of a necessary repair;
11) connectors for interconnection with the transport module used to transmit signals, media, materials and energies;
12) a transition channel leading from the rock to the transport module connectors; and
13) an underground base control unit used to control the operation and interaction of the modules;

and combinations thereof, and wherein the transport module also comprises a module selected from the group consisting of:

1) a buoyancy module with controlled buoyancy from generated pressurized gas from the cutting process or from the gas generator, and/or from a liquid lighter than the operation liquid;
2) an autonomous drive module using fuel for reactive or mechanical drive;
3) a drive module using overpressure during rising of the transport module from the underground base to the ground base;
4) a module providing for reduction of transport module friction in relation to the operation liquid in the hole;
5) a module providing for generation of gas into the buoyancy module;
6) a module providing for generation of pressure for the drive of fuel into the cutting module;
7) a source of energy;
8) a transport module control unit;
9) a communication module;
10) a vessel for the energy carrier;
11) a vessel for material;
12) a vessel for crushed rock;
13) a vessel for rock blocks;
14) conductors and connectors of the gas from the cutting process;
15) conductors and connectors of fuel and energy for the cutting and handling process, including operation media filters, and wherein the transport module has an envelope shape which allows for gliding hydrodynamic buoyancy in interaction with the borehole wall, and makes use of a supercavitation effect to achieve high velocities in the operation liquid.

2. The equipment according to claim 1, wherein the underground base includes a module for continuous production of borehole casing which module for continuous production of borehole casing also includes the following:

a) a module for producing a mixture from crushed rock, material transported from the ground and water;
b) openings, operable as connectors for supply of material;
c) an opening, operable as a connector for extrusion of the mixture; and
d) a travelling casing for shaping the mixture into sheathing.

3. The equipment according to claim 1, wherein overpressure in the transport module during rising of the transport module from the underground base towards the ground base is used to drive acceleration of the transport module movement.

4. The equipment according to claim 1, including a generating module for generating a cavitation ventilation flow providing for reduction of friction of the transport module in relation to the operation liquid in the hole by ventilated supercavitation to reach high velocities in water, wherein said generating module is adapted to make use of at least one of the following:

a) overpressure in the transport module during transport module rising from the underground base towards the ground base;
b) pressure medium formed in the autonomous drive module when fuel is used for reactive or mechanical drive; and
c) a gas generator;

to create and stabilize a supercavitation effect with the contribution of increased temperature of the transport module envelope, while interruption of the supercavitation effect is utilized for hydrodynamic decelerating effect to reduce the generating module speed.

* * * * *